US008387288B2

(12) United States Patent
Wagger et al.

(10) Patent No.: US 8,387,288 B2
(45) Date of Patent: Mar. 5, 2013

(54) ROTARY SNOW TILLER FOR GROOMING SKI SLOPES

(75) Inventors: Klaus Wagger, Brunico (IT); Jan Müller, Vipiteno (IT)

(73) Assignee: Rolic Invest S.AR.L., Luxembourg (LU)

( * ) Notice: Subject to any disclaimer, the term of this patent is extended or adjusted under 35 U.S.C. 154(b) by 181 days.

(21) Appl. No.: 12/740,969

(22) PCT Filed: Oct. 29, 2008

(86) PCT No.: PCT/EP2008/064694

§ 371 (c)(1),
(2), (4) Date: Aug. 12, 2010

(87) PCT Pub. No.: WO2009/056578

PCT Pub. Date: May 7, 2009

(65) Prior Publication Data

US 2011/0000107 A1 Jan. 6, 2011

(30) Foreign Application Priority Data

Oct. 31, 2007 (IT) ..... MI2007A002102

(51) Int. Cl.
*E01H 5/04* (2006.01)

(52) U.S. Cl. ..... 37/223

(58) Field of Classification Search ..... 37/196, 37/209, 219–223, 348; 172/68–72
See application file for complete search history.

(56) References Cited

U.S. PATENT DOCUMENTS

| | | | |
|---|---|---|---|
| 3,170,533 | A | 2/1965 | Fewel et al. |
| 3,227,295 | A | 1/1966 | Hamilton et al. |
| 3,386,778 | A | 6/1968 | Rymes |
| 3,534,701 | A | 10/1970 | Hebert |
| 3,692,132 | A | 9/1972 | Pollanen |
| 3,763,944 | A | 10/1973 | Kaltenegger |
| 4,087,135 | A | 5/1978 | Unruh |
| 4,348,825 | A | 9/1982 | Bachler |
| 4,458,954 | A | 7/1984 | Haas |
| 4,458,955 | A | 7/1984 | Webb |
| 4,500,139 | A | 2/1985 | Tucek |
| 4,788,783 | A | 12/1988 | Bachler |
| 5,062,493 | A | 11/1991 | Platter et al. |

(Continued)

FOREIGN PATENT DOCUMENTS

| | | |
|---|---|---|
| CA | 2211050 | 1/1998 |
| CA | 2443765 A1 | 4/2004 |

(Continued)

OTHER PUBLICATIONS

PistenBully 600 brochure, written by Kassbohrer Gelandefahrzeug AG, published in Mar. 2010.

(Continued)

*Primary Examiner* — Robert Pezzuto
(74) *Attorney, Agent, or Firm* — Neal, Gerber & Eisenberg LLP

(57) ABSTRACT

A rotary snow tiller, for grooming the snow covering of ski slopes, which advances in a traveling direction along the ski slope, and has a frame; and a shaft fitted with teeth and rotated with respect to the frame about an axis crosswise to the traveling direction; each tooth being fitted movably to the shaft and selectively adjustable in length with respect to the shaft.

28 Claims, 3 Drawing Sheets

U.S. PATENT DOCUMENTS

| | | | | |
|---|---|---|---|---|
| 5,067,263 | A | | 11/1991 | Pelletier |
| 5,809,671 | A | * | 9/1998 | Sinykin ..... 37/219 |
| 6,155,363 | A | | 12/2000 | Matsumoto et al. |
| 6,296,330 | B1 | | 10/2001 | Hall |
| 6,354,023 | B1 | | 3/2002 | Trahan et al. |
| 6,418,645 | B1 | | 7/2002 | Hammerle et al. |
| 6,637,134 | B2 | | 10/2003 | Hammerle |
| 6,810,609 | B2 | | 11/2004 | Lassonde et al. |
| 6,921,304 | B2 | | 7/2005 | Hewitt |
| 6,983,927 | B2 | | 1/2006 | Pelletier et al. |
| 7,464,699 | B2 | | 12/2008 | Joppig et al. |
| 7,530,547 | B2 | | 5/2009 | Leitner et al. |
| 2002/0139013 | A1 | | 10/2002 | Hammerle |
| 2003/0051376 | A1 | | 3/2003 | Lassonde et al. |
| 2003/0159840 | A1 | | 8/2003 | Schmidt, Jr. |
| 2004/0069981 | A1 | | 4/2004 | Pelletier et al. |
| 2005/0252592 | A1 | | 11/2005 | Albright et al. |
| 2005/0279980 | A1 | | 12/2005 | Leitner et al. |
| 2007/0130806 | A1 | | 6/2007 | Goodman |
| 2008/0257616 | A1 | | 10/2008 | Olsson |
| 2008/0269986 | A1 | | 10/2008 | Regnell et al. |
| 2008/0309157 | A1 | | 12/2008 | Runggaldier et al. |
| 2009/0000833 | A1 | | 1/2009 | Dorais et al. |
| 2009/0007461 | A1 | | 1/2009 | Pelletier et al. |
| 2009/0013562 | A1 | | 1/2009 | Pelletier |

FOREIGN PATENT DOCUMENTS

| | | | |
|---|---|---|---|
| DE | 2145772 | | 3/1973 |
| DE | 2148304 | | 4/1973 |
| DE | 2219623 | | 11/1973 |
| DE | 2254276 | | 5/1974 |
| DE | 3440491 | | 5/1986 |
| DE | 3534626 | | 3/1987 |
| DE | 29515866 | | 1/1996 |
| DE | 29603251 | | 4/1996 |
| DE | 10320523 | | 11/2004 |
| EP | 0551160 | A1 | 7/1993 |
| EP | 1405782 | | 4/2004 |
| EP | 1674382 | A1 | 10/2005 |
| EP | 1591350 | A2 | 11/2005 |
| EP | 1827954 | B1 | 12/2005 |
| EP | 1995159 | A1 | 6/2007 |
| EP | 1872683 | | 1/2008 |
| EP | 1908673 | B1 | 9/2009 |
| EP | 1908672 | B1 | 4/2010 |
| FR | 2336292 | | 7/1977 |
| FR | 2536437 | | 5/1984 |
| FR | 2586727 | | 3/1987 |
| GB | 1590358 | | 6/1981 |
| JP | 01144287 | | 10/1989 |
| JP | 03182887 | | 8/1991 |
| JP | 7237566 | | 9/1995 |
| WO | WO2005093173 | | 10/2005 |
| WO | WO2006069671 | | 7/2006 |
| WO | WO2006069682 | | 7/2006 |
| WO | WO2008114138 | | 9/2008 |
| WO | WO2008155423 | | 12/2008 |
| WO | WO2008155425 | | 12/2008 |
| WO | WO2009034183 | | 3/2009 |
| WO | WO2009034185 | | 3/2009 |
| WO | WO2009056576 | | 5/2009 |
| WO | WO2009056577 | | 5/2009 |
| WO | WO2009056579 | | 5/2009 |

OTHER PUBLICATIONS

PistenBully Scout brochure, written by Kassbohrer Gelandefahrzeug AG, published in Jan. 2010.

* cited by examiner

ROTARY SNOW TILLER FOR GROOMING SKI SLOPES

PRIORITY CLAIM

This application is a national stage application of PCT/EP2008/064694, filed on Oct. 29, 2008, which claims the benefit of and priority to Italian Patent Application No. MI2007A 002102, filed on Oct. 31, 2007, the entire contents of which are incorporated herein.

TECHNICAL FIELD

The present disclosure relates to a rotary snow tiller for grooming ski slopes.

BACKGROUND

Known rotary snow tillers for grooming ski slopes normally advance in a traveling direction along the ski slope, and comprise a frame; and a toothed shaft rotated with respect to the frame about an axis crosswise to the traveling direction.

Such known rotary snow tillers have proved particularly effective in grooming ski slopes. The snow covering, however, varies considerably with weather conditions, snowfall and, particularly, daily variations in temperature, and these known rotary snow tillers are equipped with standard-configuration teeth that fail to adapt to different snow covering conditions.

SUMMARY

It is an object of the present disclosure to provide a rotary snow tiller for grooming ski slopes, configured to eliminate certain of the drawbacks of the above-described known rotary snow tillers in a straightforward, low-cost manner, and in particular to adapt to different snow covering conditions.

According to the present disclosure, there is provided a rotary snow tiller, for grooming the snow covering of ski slopes, which advances in a traveling direction along the ski slope, and comprises a frame; and a shaft fitted with teeth and rotated with respect to the frame about an axis crosswise to the traveling direction; the rotary snow tiller being characterized in that each tooth is fitted movably to the shaft and selectively adjustable in length with respect to the shaft.

Additional features and advantages are described in, and will be apparent from, the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
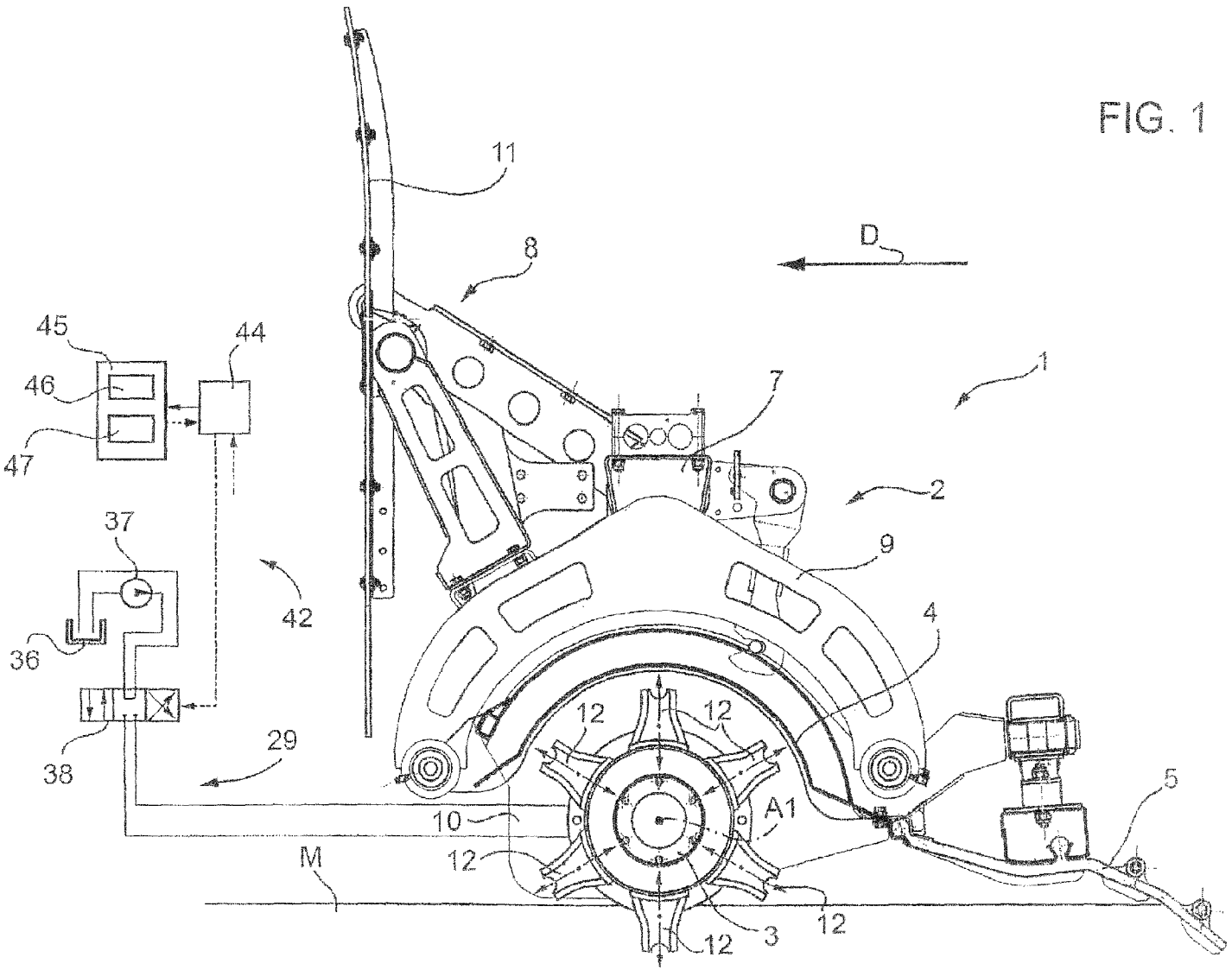
FIG. 1 shows a side view, with parts removed for clarity, of a rotary snow tiller for grooming ski slopes, in accordance with the present disclosure.

Referring now to the example embodiments of the present disclosure illustrated in FIGS. 1 to 5, number 1 in FIG. 1 indicates as a whole a rotary snow tiller for grooming the snow covering M of ski slopes, and which is towed in a traveling direction D by a snow groomer vehicle (not shown in the drawings).

Rotary snow tiller 1 is configured to till a surface layer of snow covering M, and comprises a frame 2; a shaft 3 rotated with respect to frame 2 about an axis A1 crosswise to traveling direction D; a protective casing 4 surrounding shaft 3 rotating about axis A1 crosswise to traveling direction D; a flexible finish mat 5 which is connected to casing 4, extends behind shaft 3, and is drawn over the surface of the tilled snow covering M; and an actuating device 6 (FIGS. 2 and 3) associated with and for altering the configuration of shaft 3.

Frame 2 comprises a bar 7 parallel to axis A1; a hitch device 8 fixed to bar 7 and for connecting tiller 1 to the snow groomer vehicle (not shown); two arc-shaped segments 9 (only one shown) fixed transversely to bar 7; and two plates 10 (only one shown in FIG. 1) for supporting shaft 3.

Rotary snow tiller 1 comprises two adjustable panels 11 (only one shown in FIG. 1) which act to a certain extent as splash guards to protect casing 4 and finish mat 5 from the snow thrown up by the groomer vehicle (not shown in the drawings).

Shaft 3 comprises a number of teeth 12 equally spaced about and along axis A1, and each of which projects radially from shaft 3 to penetrate snow covering M, and is adjustable in length with respect to shaft 3.

The length of shaft 3 defines the work range and the width of tiller 1 as a whole.

Figure 4:
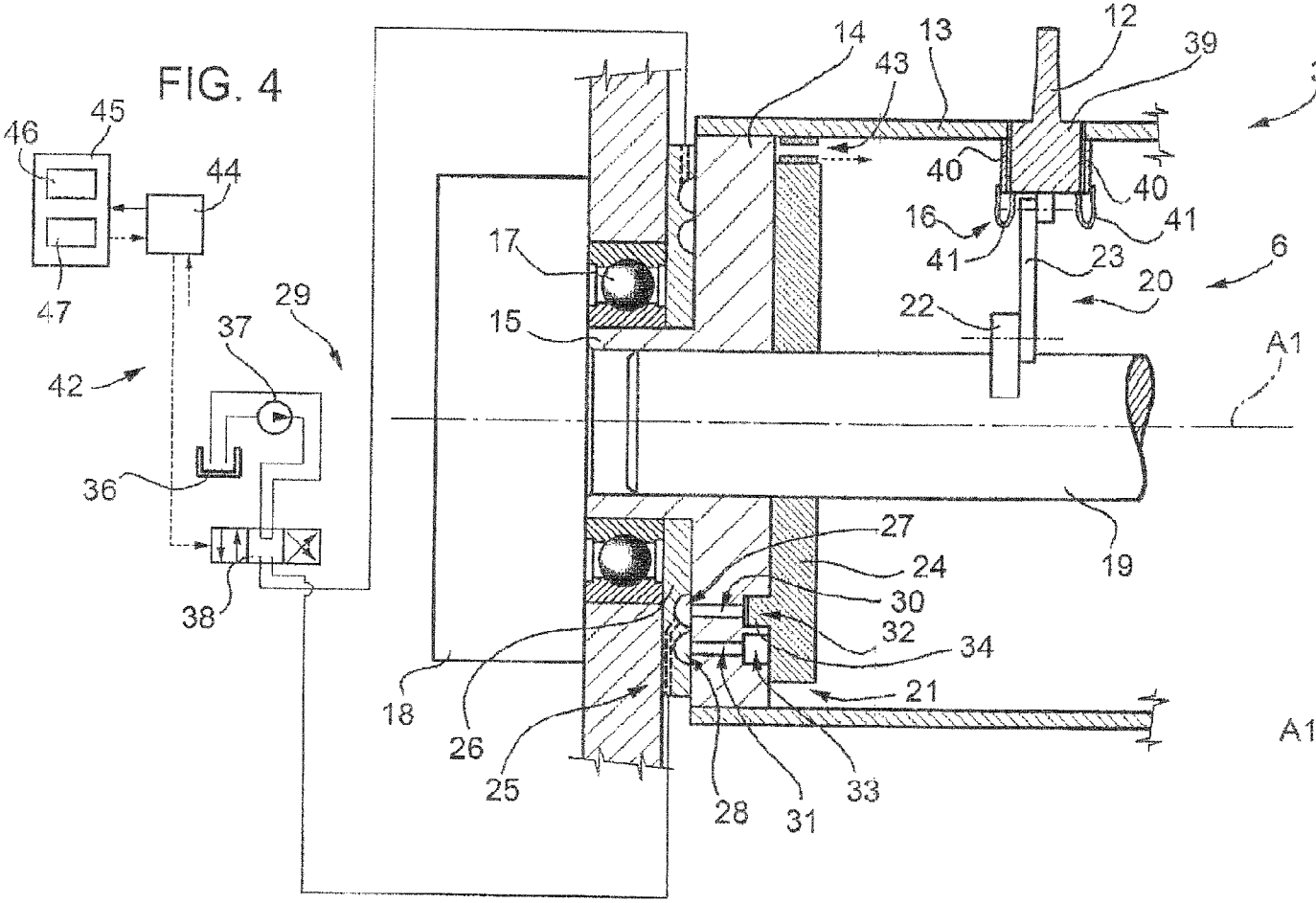
FIG. 4 shows a schematic longitudinal section, with parts in section and parts removed for clarity, of the FIG. 3 detail.

With reference to FIG. 4, shaft 3 comprises a hollow cylinder 13; two end flanges 14 (only one shown in FIG. 4) fitted to opposite ends of hollow cylinder 13; two sleeves 15 (only one shown in FIG. 4) integral with respective flanges 14; and seats 16 equally spaced along hollow cylinder 13 to house respective teeth 12. Each sleeve 15 is supported by a plate 10 of frame 2 by a respective bearing 17. And one of sleeves 15 is connected to a rotary actuator 18, such as the shown hydraulic motor, for rotating shaft 3 to till the snow covering.

Actuating device 6 comprises a actuating shaft 19 extending inside hollow cylinder 13 and supported for rotation about axis A1 by sleeves 15 and, in one embodiment, bearings (not shown in the drawings); a connecting mechanism or connector 20 between each tooth 12 and actuating shaft 19; and a hydraulic rotary actuator 21 for rotating actuating shaft 19 with respect to hollow cylinder 13.

Figure 3:
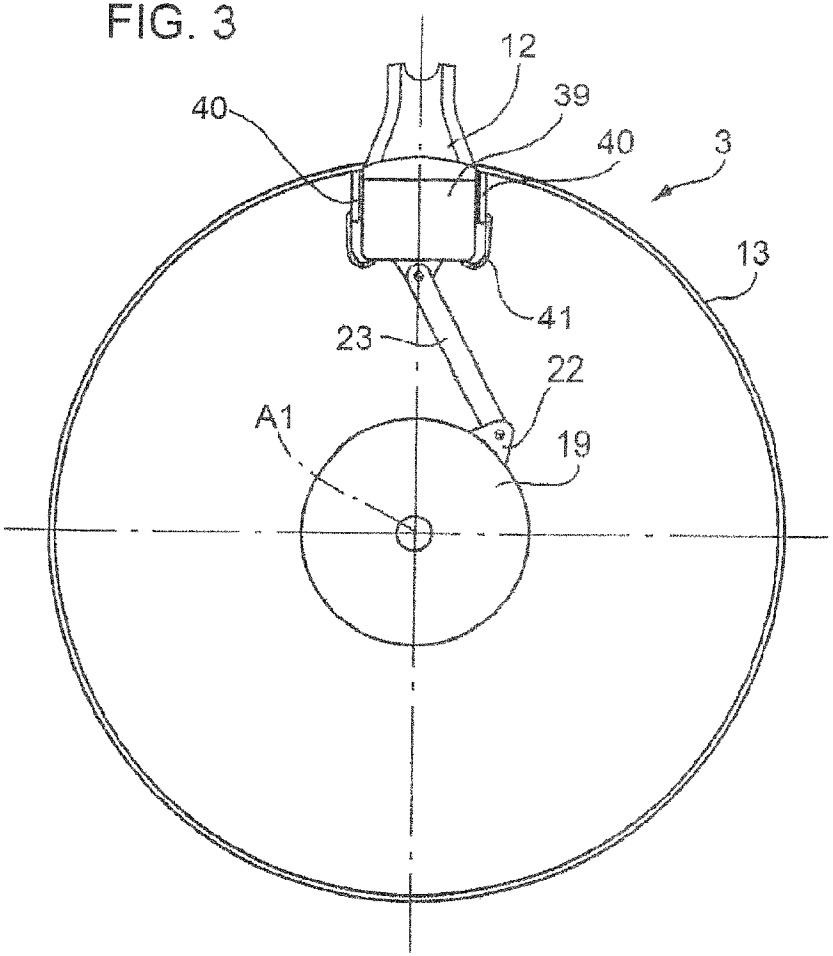
FIGS. 2 and 3 show cross sections, with parts removed for clarity, of a detail of the FIG. 1 rotary snow tiller in two operating positions.
Figure 2:
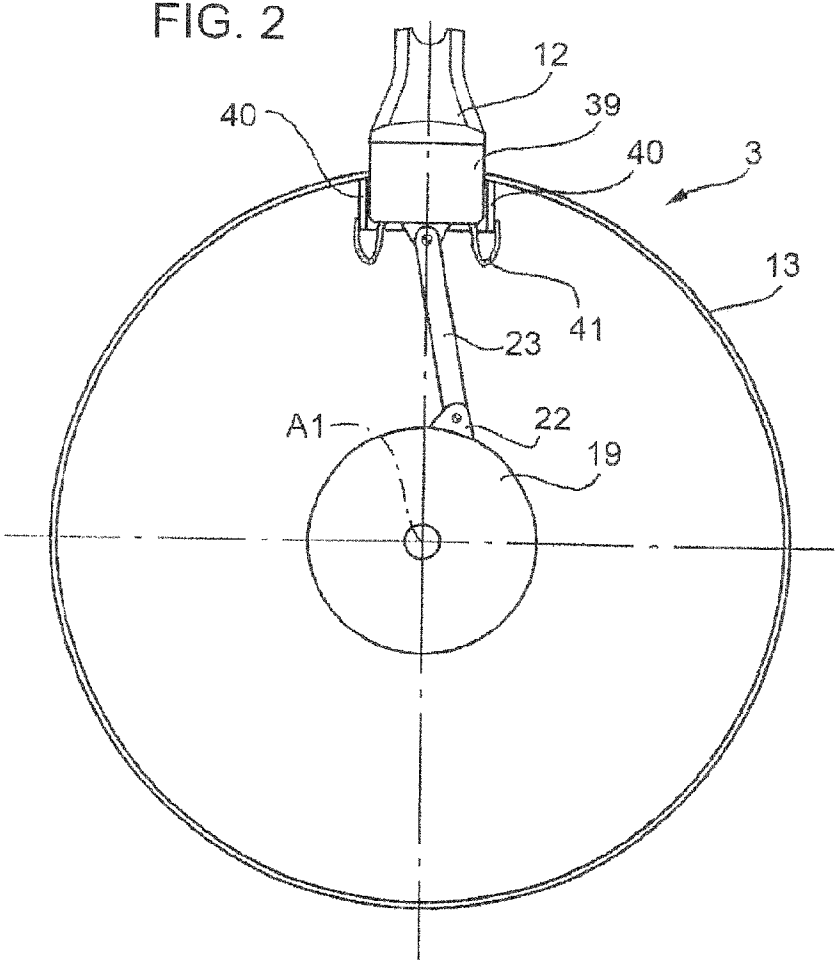

In the FIGS. 2 to 4 example, the connecting mechanism or connector comprises a crank 22 integral with actuating shaft 19; and a connecting rod 23 hinged to crank 22 and tooth 12.

With reference to FIG. 4, rotary actuator 21 comprises one of end flanges 14 and a disk 24, and is supplied by a rotary distributor 25. In the example shown, rotary distributor 25 comprises an annular disk 26 integral with plate 10 of frame 2 and fitted in sliding manner to end flange 14. Annular disk 26 comprises two annular grooves 27, 28 facing end flange 14 and communicating with a hydraulic circuit 29 which is an integral part of actuating device 6. End flange 14 has two holes 30, 31; and two sector-shaped grooves 32, 33 extending in opposite directions from respective holes 30, 31 as shown more clearly in FIG. 5. And disk 24 has two projections 34, 35 inserted inside respective grooves 32, 33. In other words, grooves 32, 33 act as cylinders, and projections 34, 35 as pistons.

Hydraulic circuit 29 comprises a tank 36, a pump 37, and a solenoid valve 38, and provides for selectively supplying groove 32 and draining groove 33, or, vice versa, supplying groove 33 and draining groove 32, to rotate actuating shaft 19 in one direction or the other with respect to hollow cylinder 13, and so adjust the length of teeth 12 by means of connecting mechanisms 20.

With reference to FIGS. 2 and 3, each tooth 12 comprises a prismatic portion 39 housed at least partly inside a respective seat 16, which substantially comprises four walls 40 (only two shown in FIGS. 2 and 3) projecting inside hollow cylinder 13.

Walls 40 are connected hermetically to an annular membrane 41 in turn connected hermetically to prismatic portion 39 to hermetically seal the inside of hollow cylinder 13.

With reference to FIGS. 1 and 4, actuating device 6 comprises a control assembly 42 in turn comprising a sensor 43; a control unit 44; and a console 45 comprising a display section 46 and a setting section 47.

Control assembly 42 interacts with the hydraulic circuit to remote-adjust the length of teeth 12, such as from the cab of the groomer vehicle (not shown in the drawings).

Figure 5:
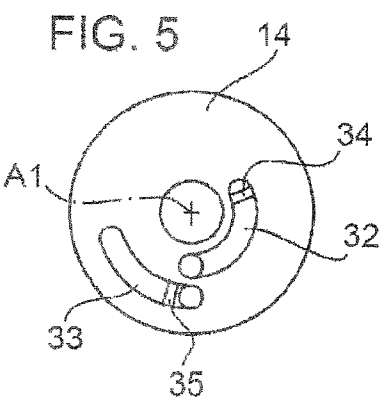
FIG. 5 shows a smaller-scale section, with parts removed for clarity, of a detail in FIG. 4.

In the embodiment illustrated in FIGS. 4 and 5, sensor 43 is located between hollow cylinder 13 and disk 24, and the length of teeth 12 is related univocally to the relative position between disk 24 and hollow cylinder 13.

Control unit 44 is connected to sensor 43, to console 45, and to solenoid valve 38 of hydraulic circuit 29.

When the set length of teeth 12 differs from the actual length of teeth 12, control unit 44 sends a correction signal to solenoid valve 38 until the actual length of teeth 12 corresponds to the set length of teeth 12.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A snow grooming rotary snow tiller comprising:

a frame;

a shaft supported by the frame, said shaft fitted with a plurality of teeth, said shaft configured to rotate with respect to the frame about an axis crosswise to a direction that the frame is configured to travel along a ski slope, each tooth being movably fitted to the shaft and selectively adjustable in length with respect to the shaft; and an actuating device configured to adjust the length of each of the teeth with respect to said shaft, the actuating device including:

an actuating shaft housed inside a cylinder and configured to rotate about the axis with respect to the cylinder; and a plurality of connectors, each connector connected to the actuating shaft and to a different one of the teeth.

2. The snow grooming rotary snow groomer of claim 1, wherein each tooth is radially movable with respect to the axis.

3. The snow grooming rotary snow groomer of claim 1, wherein the shaft includes a cylinder including a plurality of seats, each tooth being slidably fitted inside a respective seat and connected to the actuating device.

4. The snow grooming rotary snow groomer of claim 1, wherein each connecting connector includes a crank integral with the actuating shaft and a connecting rod hinged to a respective one of the teeth and to the crank.

5. The snow grooming rotary snow groomer of claim 1, wherein the actuating device includes a rotary actuator configured to rotate the actuating shaft with respect to the cylinder.

6. The snow grooming rotary snow groomer of claim 5, wherein the rotary actuator includes a hydraulic actuator.

7. The snow grooming rotary snow groomer of claim 6, which includes a rotary distributor configured to supply the rotary actuator located on the shaft.

8. The snow grooming rotary snow groomer of claim 6, wherein the rotary actuator includes an end flange integral with the cylinder, and a disk integral with the actuating shaft; the end flange and the disk being slideably connected.

9. The snow grooming rotary snow groomer of claim 1, wherein each tooth includes a prismatic portion housed at least partly inside a respective seat.

10. The snow grooming rotary snow groomer of claim 9, wherein each seat has a plurality of walls projecting inside a cylinder of the shaft.

11. The snow grooming rotary snow groomer of claim 10, wherein the walls of each seat are connected to a respective tooth by a membrane which hermetically separates the inside of the cylinder of the shaft from the outside of the cylinder of the shaft.

12. The snow grooming rotary snow groomer of claim 1, wherein the actuating device includes a hydraulic circuit and a control assembly configured to determine and set a length of each of the teeth and configured to adjust the length of each of the teeth from a position remote from each of the teeth.

13. The snow grooming rotary snow groomer of claim 12, wherein the control assembly includes:

a sensor configured to determine the length of each of the teeth, a control panel configured to set the length of each of the teeth, and a control unit configured to compare the set length of each of the teeth with an actual length of each of the teeth, and send at least one correction signal to a solenoid valve until the set length of each of the teeth corresponds to the actual length of each of the teeth.

14. A snow grooming rotary snow tiller comprising:

a frame;

a shaft supported by the frame, said shaft configured to rotate with respect to the frame about an axis, and fitted with a plurality of teeth; and an actuating device configured to selectively move each tooth toward and away from the axis, the actuating device including:

an actuating shaft housed inside a cylinder and configured to rotate about the axis with respect to the cylinder; and a plurality of connectors, each connector connected to the actuating shaft and to a different one of the teeth.

15. The snow grooming rotary snow groomer of claim 14, wherein the shaft includes a cylinder including a plurality of seats, each tooth being slidably fitted inside a respective seat and connected to the actuating device.

16. The snow grooming rotary snow groomer of claim 14, wherein the actuating device includes a rotary actuator configured to rotate the actuating shaft with respect to the cylinder.

17. The snow grooming rotary snow groomer of claim 14, wherein the actuating device includes a hydraulic circuit and a control assembly configured to determine and set a length of each of the teeth extending from the shaft and configured to adjust the length of each of the teeth from a position remote from each of the teeth.

18. The snow grooming rotary snow groomer of claim 17, wherein the control assembly includes:

a sensor configured to determine the length of each of the teeth extending from the shaft, a control panel configured to set the length of each of the teeth extending from the shaft, and a control unit configured to compare the set length of each of the teeth with an actual length of each of the teeth, and send at least one correction signal to a solenoid valve until the set length of each of the teeth corresponds to the actual length of each of the teeth.

19. A snow grooming rotary snow groomer comprising a frame;

a shaft supported by the frame, said shaft fitted with a plurality of teeth, said shaft configured to rotate with respect to the frame about an axis crosswise to a direction that the frame is configured to travel along a ski slope, each tooth being movably fitted to the shaft and selectively adjustable in length with respect to the shaft; and an actuating device configured to adjust the length of each of the teeth with respect to said shaft, the actuating device including a rotary actuator configured to rotate an actuating shaft with respect to a cylinder, wherein the rotary actuator includes a hydraulic actuator.

20. The snow grooming rotary snow groomer of claim 19, which includes a rotary distributor configured to supply the rotary actuator located on the shaft.

21. The snow grooming rotary snow groomer of claim 19, wherein the rotary actuator includes an end flange integral with the cylinder, and a disk integral with the actuating shaft; the end flange and the disk being slideably connected.

22. A snow grooming rotary snow groomer comprising:

a frame;

a shaft supported by the frame, said shaft fitted with a plurality of teeth, said shaft configured to rotate with respect to the frame about an axis crosswise to a direction that the frame is configured to travel along a ski slope, each tooth: (i) being movably fitted to the shaft, (ii) being selectively adjustable in length with respect to the shaft, and (iii) including a prismatic portion housed at least partly inside a respective seat; and an actuating device configured to adjust the length of each of the teeth with respect to said shaft.

23. The snow grooming rotary snow groomer of claim 22, wherein each seat has a plurality of walls projecting inside a cylinder.

24. The snow grooming rotary snow groomer of claim 23, wherein the walls of each seat are connected to a respective tooth by a membrane which hermetically separates the inside of the cylinder from the outside of the cylinder.

25. A snow grooming rotary snow groomer comprising:

a frame;

a shaft supported by the frame, said shaft fitted with a plurality of teeth, said shaft configured to rotate with respect to the frame about an axis crosswise to a direction that the frame is configured to travel along a ski slope, each tooth being movably fitted to the shaft and selectively adjustable in length with respect to the shaft; and an actuating device configured to adjust the length of each of the teeth with respect to said shaft, the actuating device including a hydraulic circuit and a control assembly configured to determine and set a length of each of the teeth and configured to adjust the length of each of the teeth from a position remote from each of the teeth.

26. The snow grooming rotary snow groomer of claim 25, wherein the control assembly includes:

a sensor configured to determine the length of each of the teeth, a control panel configured to set the length of each of the teeth, and a control unit configured to compare the set length of each of the teeth with an actual length of each of the teeth, and send at least one correction signal to a solenoid valve until the set length of each of the teeth corresponds to the actual length of each of the teeth.

27. A snow grooming rotary snow groomer comprising:

a frame;

a shaft supported by the frame, said shaft configured to rotate with respect to the frame about an axis, and fitted with a plurality of teeth; and an actuating device configured to selectively move each tooth toward and away from the axis, the actuating device including a hydraulic circuit and a control assembly configured to determine and set a length of each of the teeth extending from the shaft and configured to adjust the length of each of the teeth from a position remote from each of the teeth.

28. The snow grooming rotary snow groomer of claim 27, wherein the control assembly includes:

a sensor configured to determine the length of each of the teeth extending from the shaft, a control panel configured to set the length of each of the teeth extending from the shaft, and a control unit configured to compare the set length of each of the teeth with an actual length of each of the teeth, and send at least one correction signal to a solenoid valve until the set length of each of the teeth corresponds to the actual length of each of the teeth.

* * * * *